US006896948B1

(12) United States Patent
Griswold

(10) Patent No.: US 6,896,948 B1
(45) Date of Patent: May 24, 2005

(54) COMPUTER MOUSE COVER

(76) Inventor: Matthew L. Griswold, 10 Cedar Grove, Lucas Court, Leamington Spa (GB), CV32-5JL ( * ) Notice: Subject to any disclaimer, the term of this patent is extended or adjusted under 35 U.S.C. 154(b) by 144 days.

(21) Appl. No.: 10/207,757

(22) Filed: Jul. 30, 2002

(51) Int. Cl.[7] ..... B44C 1/26; H01H 13/04

(52) U.S. Cl. ..... 428/67; 428/187; 428/542.2; 200/333; D14/405

(58) Field of Search ..... 428/67, 187, 192, 428/542.2; 200/333; 248/205.3; D14/458, 405; 379/451; 345/156, 163

(56) References Cited

U.S. PATENT DOCUMENTS 4,073,671 A * 2/1978 Licata ..... 156/219
5,587,218 A * 12/1996 Betz ..... 428/67
6,040,539 A * 3/2000 Hiegel ..... 200/302.1

FOREIGN PATENT DOCUMENTS

WO WO01/45076 A1 * 6/2001

* cited by examiner

*Primary Examiner*—Donald J. Loney

(57) ABSTRACT

A computer mouse cover provides a grip for a computer mouse. The computer mouse has a top, a bottom and a peripheral side wall. The peripheral edge including a rounded end opposite of an end has actuators thereon. The cover includes a panel having a shape and size adapted for covering the top of the mouse from the rounded end to the actuators. The panel has a pair of side edges and an end edge. A perimeter wall is attached to and extends downward from the side edges and the end edge. The perimeter wall is adapted for frictionally engaging the peripheral side wall of the mouse. A badge having indicia thereon is positioned in a depression extending into an outer surface of the panel.

6 Claims, 3 Drawing Sheets

COMPUTER MOUSE COVER

BACKGROUND OF THE INVENTION

1. Field of the Invention

The present invention relates to mouse coverings and more particularly pertains to a new mouse covering for positioning on a mouse for offering better grip and comfort for the user of a computer mouse device.

2. Description of the Prior Art

The use of mouse coverings is known in the prior art. U.S. Pat. No. 6,099,929 describes a sheet which is flexible and is removably attachable to a mouse so that the mouse buttons may still be actuated though they are covered with the sheet. The sheet may have advertising or other indicia thereon. Another type of mouse covering is U.S. Pat. No. 6,099,934 having a covering which covers the top of a mouse but not the buttons and includes a flap for the attachment of a 3-dimensional object thereto.

While these devices fulfill their respective, particular objectives and requirements, the need remains for a device which offers comfort while at the same time offering a badge for the positioning of indicia logo.

SUMMARY OF THE INVENTION

The present invention meets the needs presented above by providing a cover which is positioned over the top of a computer mouse while leaving the actuator buttons of the computer mouse exposed.

Still yet another object of the present invention is to provide a new computer mouse covering that provides a more comfortable grip for a user of the computer mouse which is covered.

Even still another object of the present invention is to provide a new computer mouse covering that includes a badge embedded therein having indicia thereon.

To this end, the present invention generally comprises a mouse cover device for removably attaching to a computer mouse. The mouse has a top, a bottom and a peripheral side wall. The peripheral edge including a rounded end opposite of an end has actuators thereon. The peripheral side wall has an equatorial slot extending therein. The device includes a panel having a shape and size adapted for covering the top of the mouse from the rounded end to the actuators. The panel has a pair of side edges and an end edge. A perimeter wall is attached to and extends downward from the side edges and the end edge. The perimeter wall is adapted for frictionally engaging the peripheral side wall of the mouse. A badge is positioned in a depression extending into an outer surface of the panel. The badge has indicia thereon.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
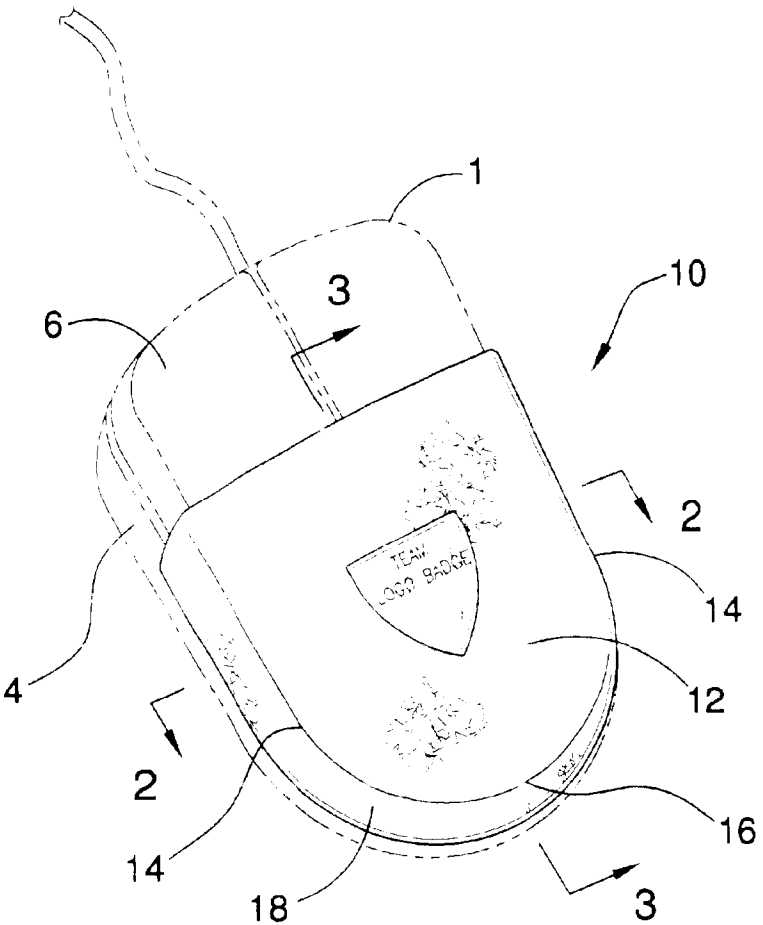
FIG. 1 is a schematic perspective view of a computer mouse cover according to the present invention.
Figure 2:
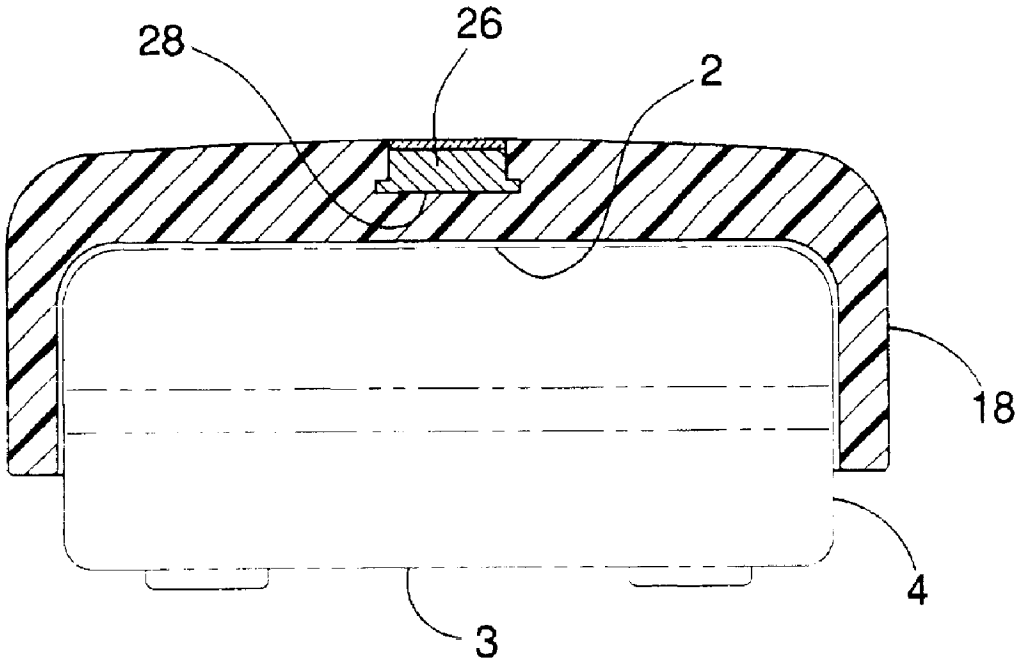
FIG. 2 is a schematic cross-sectional view taken along line 2—2 of FIG. 1 of the present invention.
Figure 3:
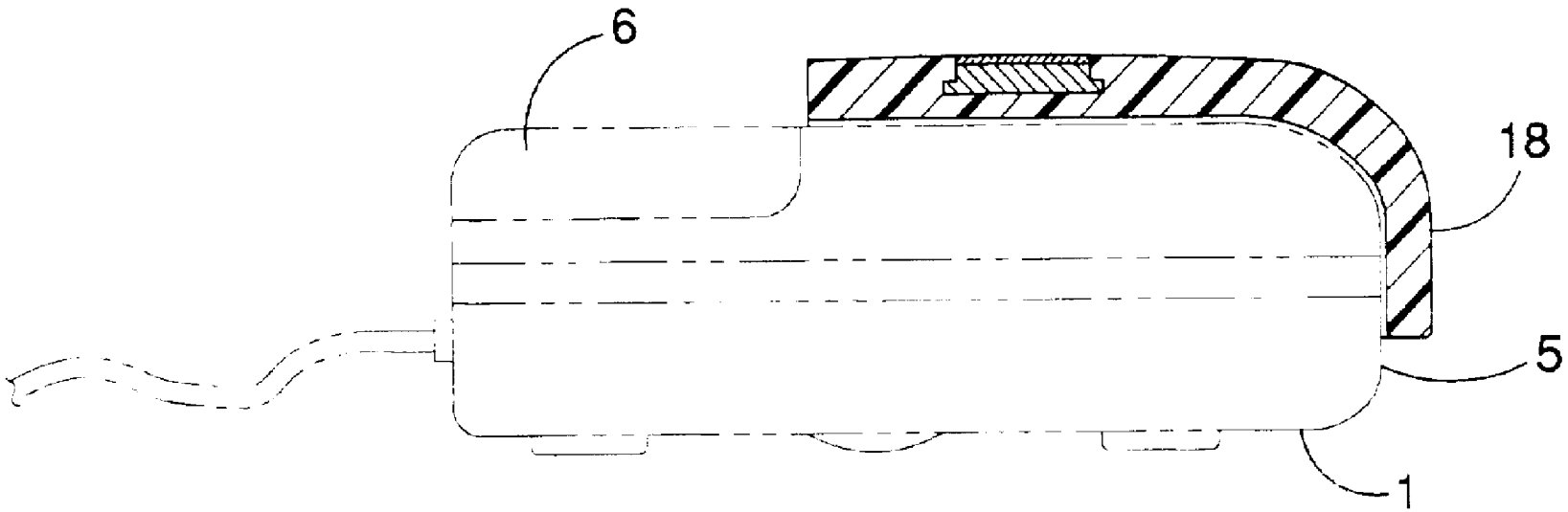
FIG. 3 is a schematic cross-sectional view taken along line 3—3 of the present invention.

With reference now to the drawings, and in particular to FIGS. 1 through 3 thereof, a new mouse covering embodying the principles and concepts of the present invention and generally designated by the reference numeral 10 will be described.

As best illustrated in FIGS. 1 through 3, the computer mouse cover 10 generally comprises a device for removably attaching to a computer mouse 1. The mouse 1 has a top 2, a bottom 3 and a peripheral side wall 4. The peripheral edge 4 includes a rounded end 5 opposite of an end having actuators 6 thereon. The shape of this mouse 1 is only illustrative and the device 10 herein defined may be contoured to fit alternate variations of computer mouse designs.

The device 10 includes a panel 12 having a shape and size adapted for covering the top 2 of the mouse 1 from the rounded end 5 to the actuators 6. The panel 12 has a pair of side edges 14 and an end edge 16. A perimeter wall 18 is attached to and extends downward from the side edges 14 and the end edge 16. The panel 12 and perimeter wall 18 preferably comprises a resiliently compressible material or a molded resiliently flexible plastic material. An outer surface of the panel 12 and perimeter wall 18 may be textured to simulate leather. When positioned on the mouse 1, an inner surface of the device 10 frictionally engages an outer surface of the mouse.

A badge 26 is positioned in a depression 28 extending into the outer surface of the panel 12. The badge 26 has a same shape as the depression 28 and is frictionally coupled to a side edge of the depression 28. The badge 26 has indicia thereon. Ideally, an adhesive may be used for holding the badge 28 in the depression. The indicia may have any type of logo or advertisement thereon. The badge 26 may be removable so that a used may selectively choose the type of logo that is positioned in the panel 12.

In use, the panel 12 is positioned on the computer mouse 1 so that the panel 12 is frictionally coupled thereto. The badge 26 provides decoration or advertisement while the dual layer panel 12 provides a comfortable and soft gripping member for the mouse 1.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mouse cover device for removably attaching to a computer mouse, the mouse having a top, a bottom and a peripheral side wall, the peripheral edge including a rounded end opposite of an end having actuators thereon, said device comprising:

a panel having a shape and size adapted for covering the top of the mouse from the rounded end to the actuators, said panel having a pair of side edges and an end edge, a perimeter wall being attached to and extending downward from said side edges and said end edge, said perimeter wall being adapted for frictionally engaging the peripheral side wall of the mouse; and a badge being positioned in a depression extending into an outer surface of said panel, said depression being positioned between and spaced from said side edges, said badge having indicia thereon.

2. The mouse cover device as in claim 1, wherein said panel and perimeter wall comprises a resiliently flexible plastic material.

3. The mouse cover device as in claim 1, wherein said badge is frictionally coupled to a side edge of said depression such that said badge may be removed from said panel.

4. The mouse cover device as in claim 1, wherein an adhesive secures said badge in said depression.

5. A mouse cover device for removably attaching to a computer mouse, the mouse having a top, a bottom and a peripheral side wall, the peripheral edge including a rounded end opposite of an end having actuators thereon, said device comprising:

a panel having a shape and size adapted for covering the top of the mouse from the rounded end to the actuators, said panel having a pair of side edges and an end edge, a perimeter wall being attached to and extending downward from said side edges and said end edge, said panel and perimeter wall comprising a resiliently flexible plastic material; and a badge being removably positioned in a depression extending into an outer surface of said panel, said depression being positioned between and spaced from said side edges, said badge having a same shape as said depression, said badge being frictionally coupled to a side edge of said depression, said badge having indicia thereon.

6. A mouse cover device for removably attaching to a computer mouse, the mouse having a top, a bottom and a peripheral side wall, the peripheral edge including a rounded end opposite of an end having actuators thereon, said device comprising:

a panel having a shape and size adapted for covering the top of the mouse from the rounded end to the actuators, said panel having a pair of side edges and an end edge, a perimeter wall being attached to and extending downward from said side edges and said end edge, said panel and perimeter wall comprising a resiliently flexible plastic material; and a badge being removably positioned in a depression extending into an outer surface of said panel, said depression being positioned between said side edges, said badge having a same shape as said depression, said badge having a height such that said badge is substantially flush with an upper surface of said panel, said badge being frictionally coupled to a side edge of said depression, said badge having indicia thereon.

* * * * *